US005174200A

United States Patent [19]

Jeandel et al.

[11] Patent Number: 5,174,200

[45] Date of Patent: Dec. 29, 1992

[54] SHELVING SYSTEM WITH REMOVABLE SHELVES

[75] Inventors: Michel Jeandel; Michel Penard, both of Marne la Vallee, France

[73] Assignee: Cidelcem, France

[21] Appl. No.: 675,191

[22] Filed: Mar. 26, 1991

[30] Foreign Application Priority Data

Mar. 27, 1990 [FR] France ..... 90 03893
Mar. 27, 1990 [FR] France ..... 90 03894

[51] Int. Cl.[5] ..... A47B 3/00
[52] U.S. Cl. ..... 108/111; 108/107
[58] Field of Search ..... 108/111, 107, 106, 144, 108/153; 211/186, 187, 190, 191, 207

[56] References Cited

U.S. PATENT DOCUMENTS

| | | | |
|---|---|---|---|
| 2,820,551 | 1/1958 | Mount | 108/111 X |
| 2,919,816 | 1/1960 | Maslow | 108/111 |
| 3,081,717 | 3/1963 | Yurevich | 108/107 |
| 3,294,043 | 12/1966 | Joyce | 108/111 |
| 4,151,917 | 5/1979 | Pugh | 211/187 X |
| 4,405,052 | 9/1983 | Spiros | 211/187 X |
| 4,821,649 | 4/1989 | Andersson | 108/111 X |
| 4,996,929 | 3/1991 | Saal | 108/107 |

FOREIGN PATENT DOCUMENTS

| | | |
|---|---|---|
| 1286722 | 1/1969 | Fed. Rep. of Germany . |
| 1554456 | 8/1971 | Fed. Rep. of Germany . |
| 2739147 | 3/1979 | Fed. Rep. of Germany . |
| 2154429 | 9/1985 | United Kingdom . |

*Primary Examiner*—Jose V. Chen
*Attorney, Agent, or Firm*—Sughrue, Mion, Zinn, Macpeak & Seas

[57] ABSTRACT

A shelving system with removable shelves (13) comprises pairs (1) of uprights (2) that are interconnected by cross-bars (3). It is characterized in that the uprights (2) of a pair (1) are provided on their facing faces (4) with regularly spaced apart pegs (6) on which riders (8) are placed, which riders can be removed only by being lifted. The riders (8) are each provided with one or two lateral fastening lugs (9) projecting beyond the footprint of the pair (1) of uprights (2) and co-operating with respective recesses (15) situated in each of the corners (14) of each shelf (13) to support said shelf (13). The shelves are easily installed and removed without tools and cleaning is easy.

5 Claims, 8 Drawing Sheets

SHELVING SYSTEM WITH REMOVABLE SHELVES

The present invention relates to a shelving system with removable shelves, and including pairs of uprights interconnected by cross-bars.

There are essentially two types of prior shelving system, constituted:

either by shelves including fixing members at their four corners for fixing to the uprights, thereby making it possible to set up shelves at various levels;

or else by removable shelves placed on spacers interconnecting transverse support frames.

In the first case, assembly is fairly difficult and since the shelves are not removable, they are difficult to clean.

In the second case, unused fastening members constitute obstacles when putting things on the shelves, which obstacles may possibly turn out to be dangerous and/or ugly, and in addition they get in the way of cleaning and may therefore fail to comply with hygiene standards.

In addition, it is necessary to use spacers, thereby complicating assembly and disassembly.

The system of the invention avoids these drawbacks and is characterized in that the uprights of a pair are provided on their facing faces with regularly spaced apart pegs on which riders are placed that can be removed only by being lifted, said riders each being provided with one or two lateral fastening lugs that project beyond the footprint of the pair of uprights and that co-operate with respective recesses situated in each of the corners of each shelf to support said shelf.

The system can be assembled and disassembled by one person alone, even without training. In addition, such assembly and disassembly does not require the use of tools.

In the system of the invention, the riders are installed only when required for supporting a shelf. They therefore do not get in the way of cleaning.

In addition, with the shelving system of the invention and using riders with two lugs, it is possible to make use of the same pair of uprights for supporting shelves on both sides of said pair.

Naturally, riders having two lugs are used only when it is desired to support shelves on both sides of the pair of uprights, so as not to get in the way of cleaning and so as to avoid increasing the overall length of the shelving system.

In another preferred embodiment of the invention, the pegs are arch-shaped, with their edges being provided with respective grooves that receive beading on the riders.

Such pegs do not get in the way of cleaning when they are not in use and in addition they ensure that a rider is locked in position without any rotation being possible, while nevertheless allowing it to be removed easily.

In a variant, the present invention also provides a shelving system with removable shelves, the system comprising pairs of uprights with the uprights of a pair being provided on their facing faces with dovetail tongues that are used for fixing cross-bars whose ends are provided with grooves that are complementary in shape to the tongues, the system being characterized in that the tongues are split up by regularly spaced apart gaps into lengths on the tops of which riders provided with stopped grooves that are complementary in shape to the tongues are placed, said riders each being provided with one or two lateral fastening lugs projecting beyond the footprint of the pair of uprights and co-operating with respective recesses situated in each of the corners of each shelf to support said shelf.

The present invention will be better understood in the light of the following description, in which.

Figure 1:
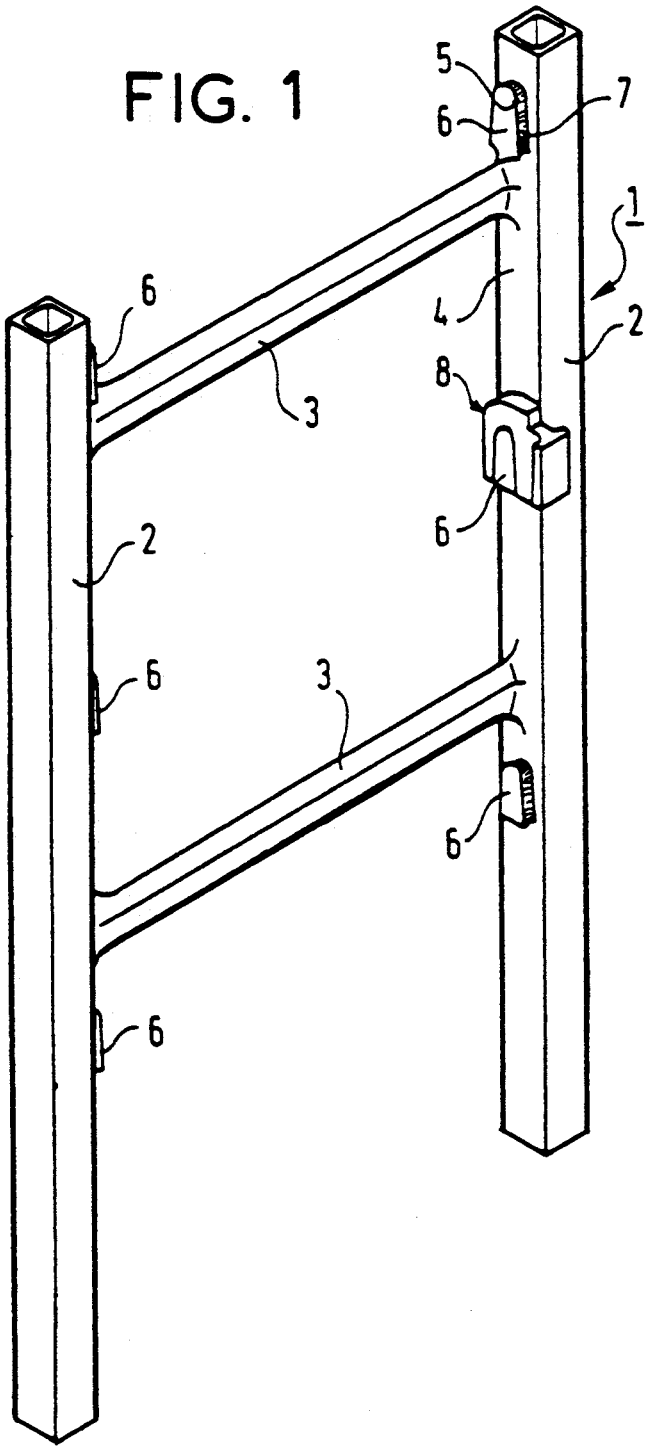
FIG. 1 shows a pair of uprights of the invention.

The shelving system of the invention (see FIG. 1) comprises pairs 1 of uprights 2 interconnected by cross-bars 3. Arch-shaped pegs 6 are provided on the facing faces 4 of the two uprights 2. The pegs 6 are regularly spaced apart on the face 4, and they are provided on their edges 5 with respective grooves 7.

Figure 2:
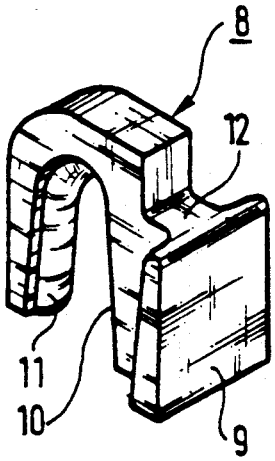
FIG. 2 shows a first type of rider of the invention.

Riders 8 including respective lateral fastening lugs 9 (see FIG. 2) are slotted vertically onto the pegs 6. Each rider 8 is provided with a slot 10 complementary to the pegs 6, and each slot 10 includes beading 11 that is received in the groove 7 of a peg, thereby preventing the rider from moving unless it is lifted.

The lateral lug 9 is held by a flat 12 projecting beyond the "footprint" of the pair 1 of uprights.

Figure 3:
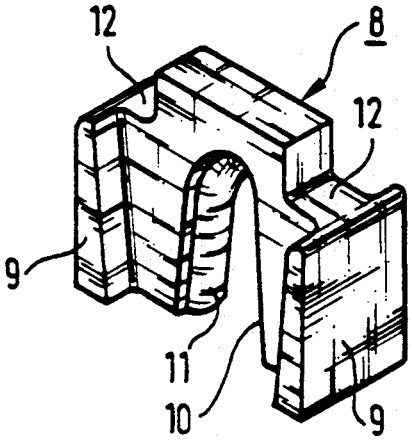
FIG. 3 shows a second type of rider of the invention.

It is also possible for a peg 6 to receive a rider 8 that has two lateral fastening lugs 9 (see FIG. 3).

Figure 4:
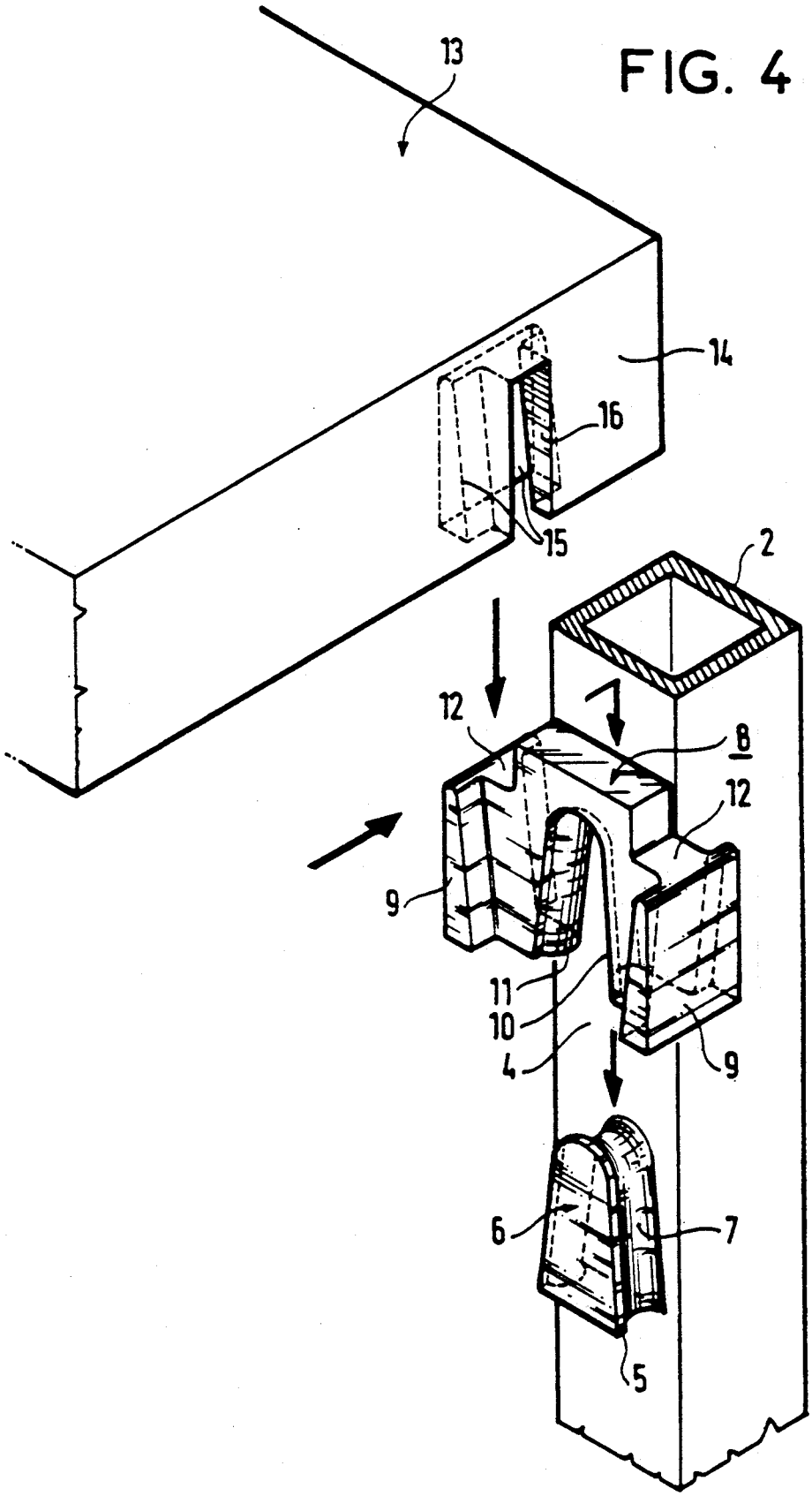
FIG. 4 is an exploded perspective view showing a portion of the shelving of FIG. 5.

The lugs 9 are tapering in shape and are used for fastening shelves 13 whose corners 14 include respective recesses 15 that are complementary in shape to the lugs 9. Each recess is provided with a notch 16 through which the flat 12 supporting the lug 9 must pass (see FIG. 4).

To assemble shelving, two pairs 1 of uprights 2 are taken and four pegs 6 situated at the same height are fitted with riders 8. The two recesses 15 at one end of a shelf 13 are slotted onto the lateral lugs 9 of the two riders 8 on one of the pairs 1, after which the two recesses 15 at the other end are slotted onto the lateral lugs 9 of the two riders 8 on the other pair 1.

The recesses 15 of the shelves 13 are locked onto the lugs 9 under the effect of the weight of the shelves and of their loads.

Other shelves 13 are then installed at other desired levels.

Figure 5:
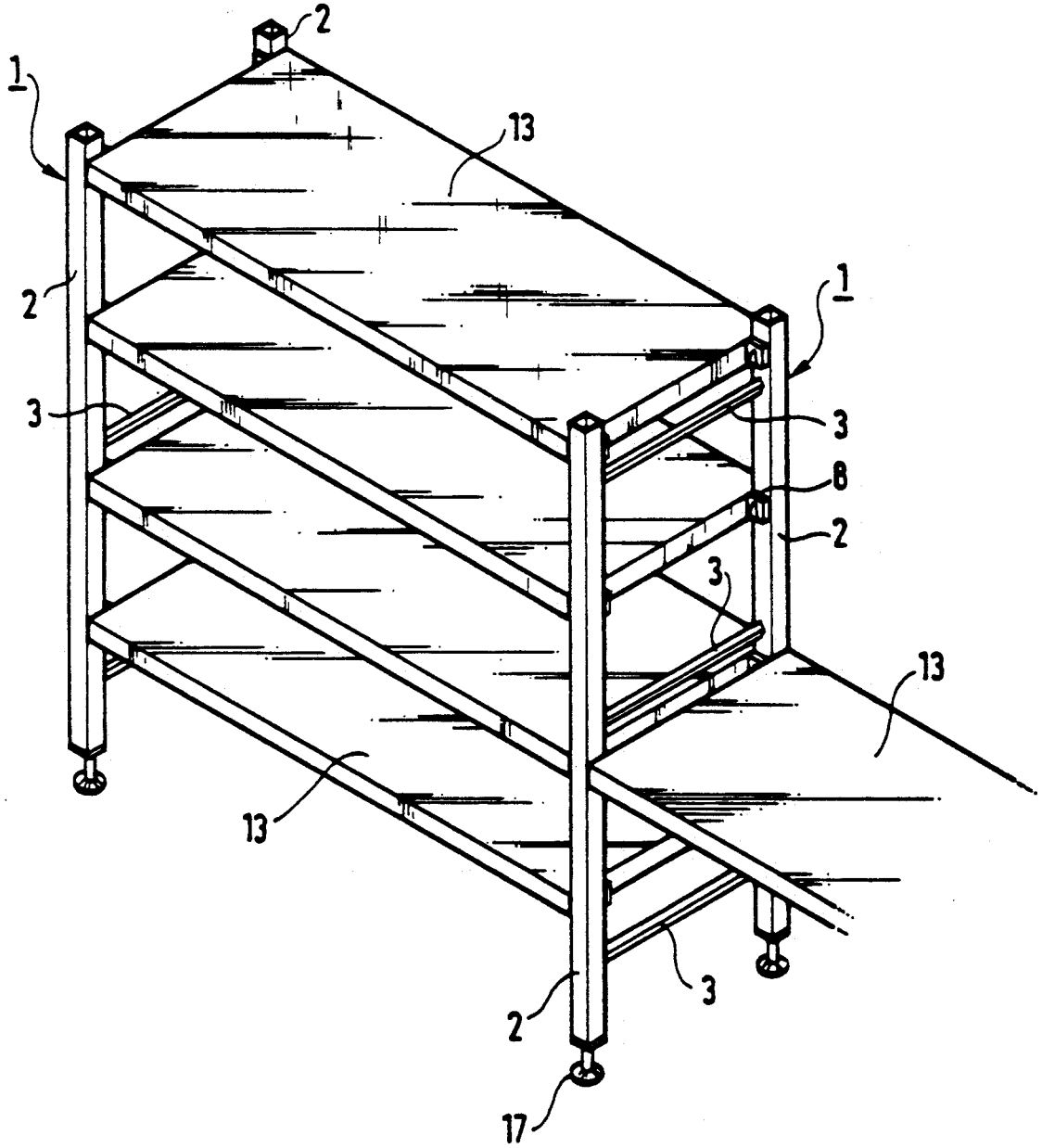
FIG. 5 shows a shelving system of the invention.

The depth of the shelves 13 is close to the total width of each pair 1 of uprights 2 (see FIG. 5).

Assembly is easy and no tools are required. It is also very easy to remove a shelf 13 merely by lifting it.

Naturally the riders 8 are not left in place since they would get in the way of cleaning the shelving.

It should be observed that the pegs 6 are easy to clean.

With the system of the invention it is very easy to take away or to add a shelf 13 between two shelves 13 that are relatively close together even though the shelves are deeper than the spacing between the two uprights 2 in a pair 1.

It is also possible to use a pair 1 of uprights 2 as a support for two sets of shelves 13 disposed on opposite sides of said pair. It suffices merely to slot riders 8 having two lugs 9 (see FIG. 5) onto those pegs that are to support two shelves 13.

In addition, when two shelves are installed in this way on opposite sides of the pair of uprights, they are at the same level.

It may be observed that the shelving of the invention satisfies hygiene standards which prohibit uprights 2 that have holes for the purpose of supporting shelves 13.

The bottoms of the uprights are preferably provided with screws 17 enabling them to be adjusted vertically for standing on uneven ground.

In the above description, the pegs 6 project from the face 4 of each upright 2, however although less advantageous from the manufacturing point of view, they could be disposed inside hollows formed in such a face 4 providing that the lateral lugs 9 of the riders 8 installed thereon project beyond the footprint of the pair 1 of uprights 2.

Figure 6:
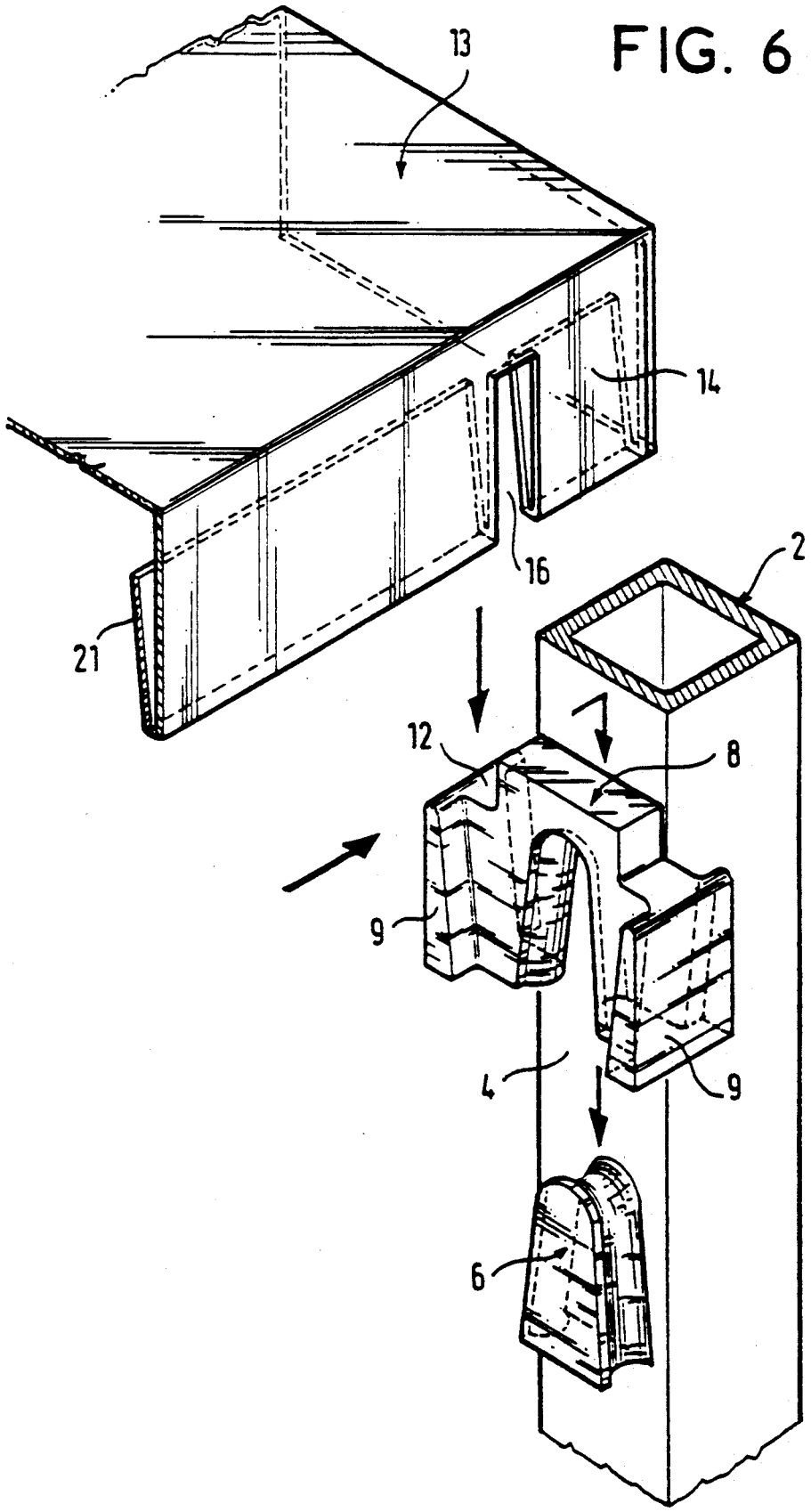
FIG. 6 shows a variant of the invention.

FIG. 6 shows a variant in which each end of a shelf 13 includes an inside flap 21 folded up from the bottom edge of the end. The notch 16 is formed both in the end face and in the inside flap 21. On assembly, the inside flap 21 presses against the lug 9 of the rider 8.

Figure 7:
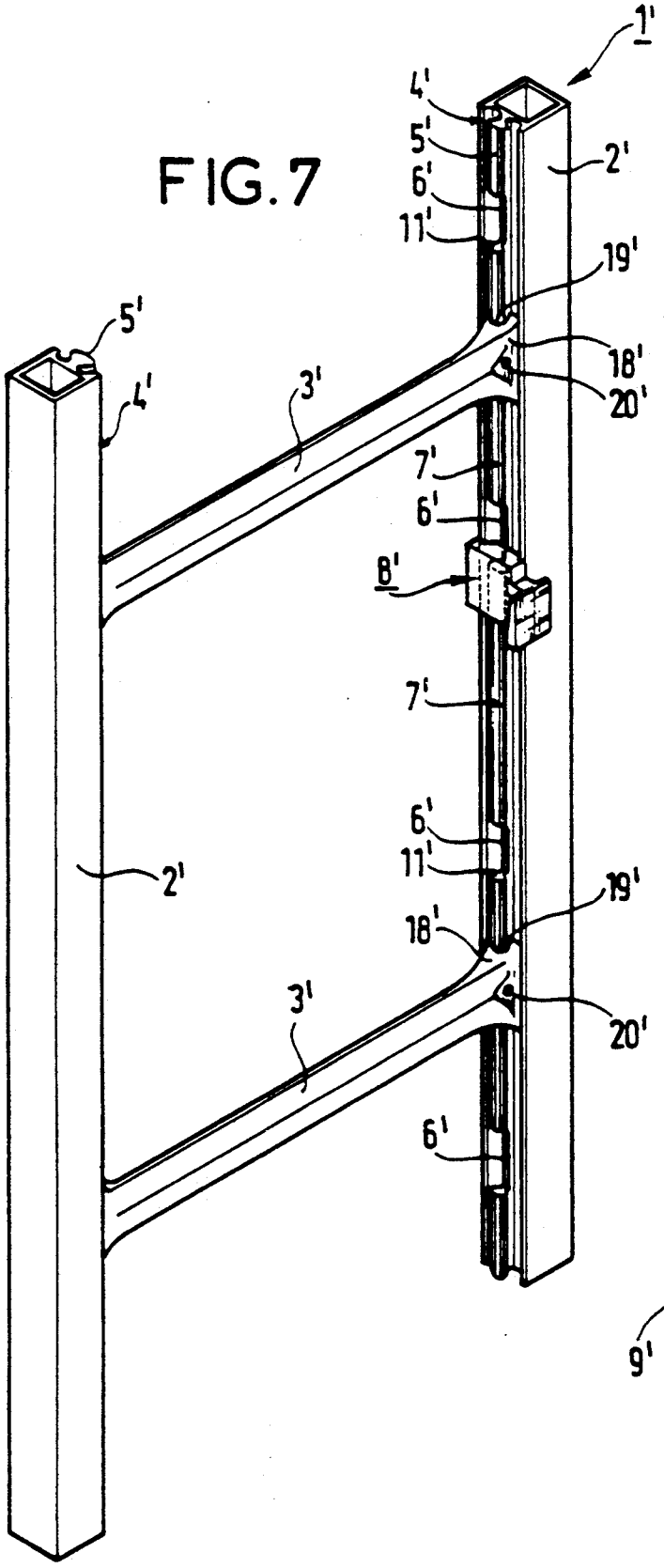
FIG. 7 shows a variant pair of uprights of the invention.

In a variant shelving system of the invention (see FIG. 7) pairs 1' of uprights 2' are interconnected by cross-bars 3'. The facing faces 4' of the two uprights 2' are provided with respective dovetail tongues 5'. The ends 18' of the cross-bars 3' are provided with grooves 19' that are complementary in shape to the tongues 5' that are held captive therein. Screws 20' or any other fixing means serve to lock the cross-bars 3' on the tongues 5'. The tongues include gaps 6' regularly spaced apart vertically and splitting them up into lengths 7'.

Figure 8:
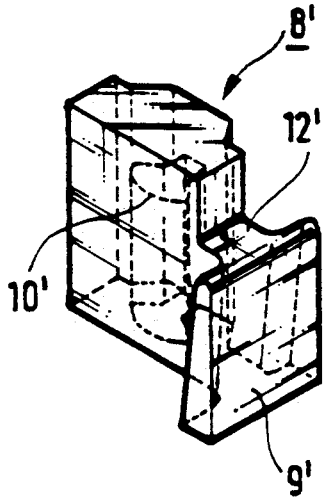
FIG. 8 shows a first type of rider for the FIG. 7 variant.

A rider 8' having a lateral fastening lug 9' (see FIG. 8) can be slotted on to the top 11' of any of the lengths 7'. The rider 8' includes a stopped groove 10' which is complementary in shape to the tongue 5' and which thus retains the top 11' of a length 7' preventing the rider 8' from moving unless it is lifted.

The lateral lug 9' is held by a flat 12' projecting beyond the "footprint" of the pair 1' of uprights.

Figure 9:
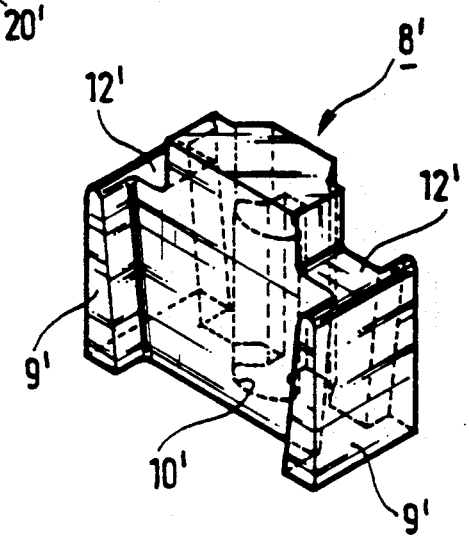
FIGS. 9 and 10 show a second type of rider for the FIG. 7 variant.
Figure 10:
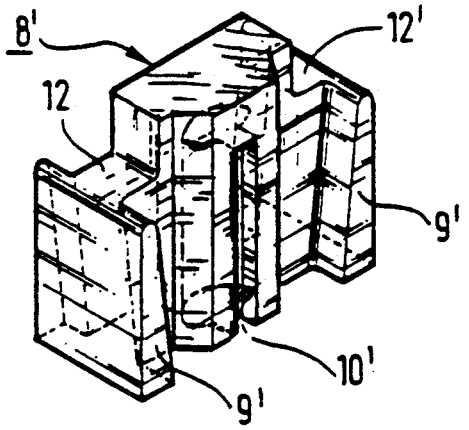

It is also possible for a top 11' to receive a rider 8' that has two lateral fastening lugs 9' (see FIGS. 9' and 10).

The lugs 9' are tapering in shape and are used for fastening shelves 13' whose corners 14' include respective recesses 15' that are complementary in shape to the lugs 9'. Each recess is provided with a notch 16' through which the flat 12' supporting the lug 9' must pass (see FIG. 11).

To assemble shelving, two pairs 1' of uprights 2' are taken and four tops 11' situated at the same height are fitted with riders 8'. The two recesses 15' at one end of a shelf 13' are slotted onto the lateral lugs 9' of the two riders 8' on one of the pairs 1', after which the two recesses 15' at the other end are slotted onto the lateral lugs 9' of the two riders 8' on the other pair 1'.

The recesses 15' of the shelves 13' are locked onto the lugs 9' under the effect of the weight of the shelves and of their loads.

Other shelves 13' are then installed at other desired levels.

Figure 12:
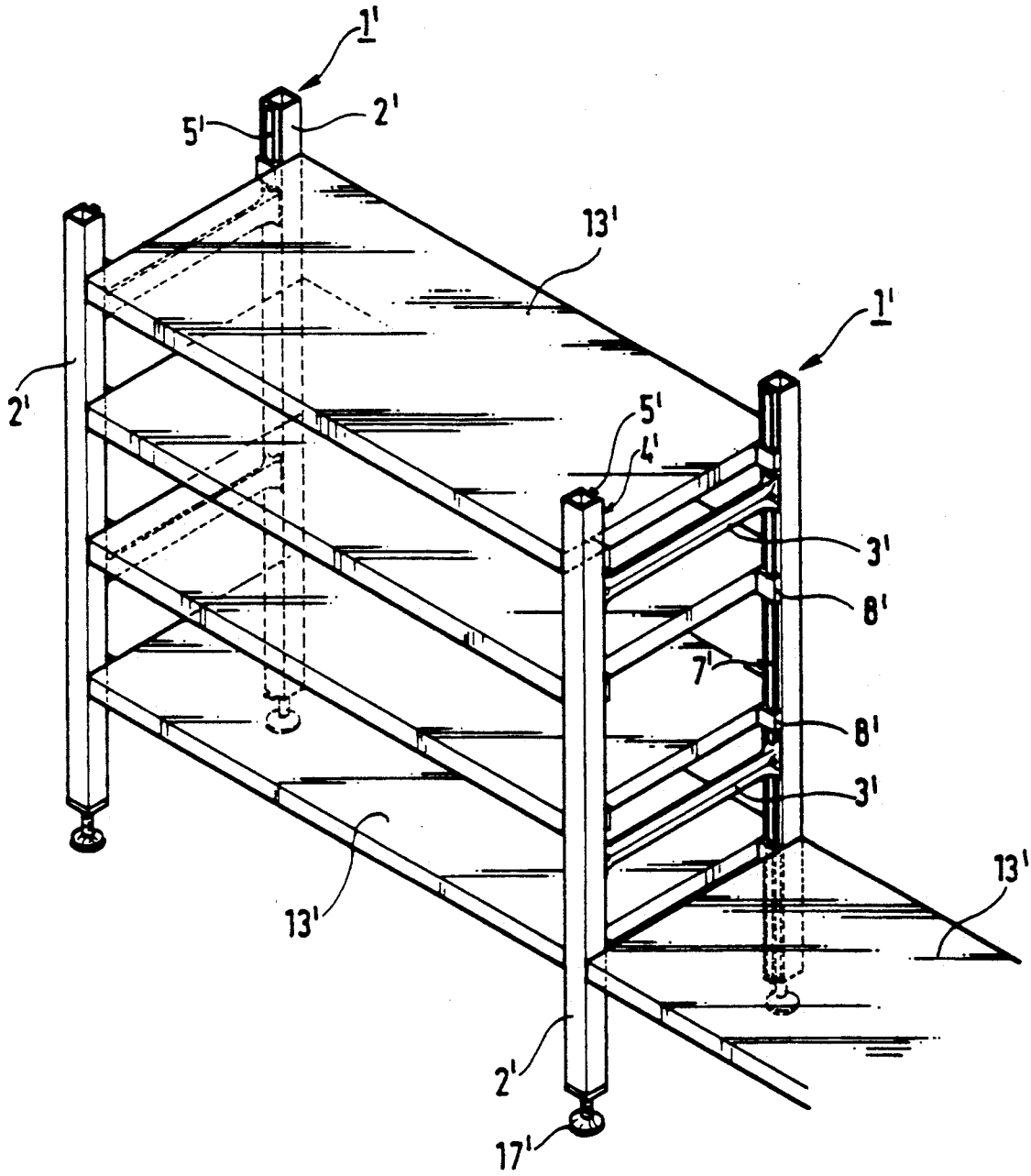
FIG. 12 shows a variant shelving system of the invention.

The depth of the shelves 13' is close to the total width of each pair 1 of uprights 2' (see FIG. 12).

Assembly is easy and no tools are required. It is also very easy to remove a shelf 13' merely by lifting it.

Naturally the riders 8' are not left in place since they would get in the way of cleaning the shelving.

It should be observed that the tongues 5' are easy to clean.

With the system of the invention it is very easy to take away or to add a shelf 13' between two shelves 13' that are relatively close together even though the shelves are deeper than the spacing between the two uprights 2' in a pair 1'.

It is also possible to use a pair 1 of uprights 2' at a support for two sets of shelves 13' disposed on opposite sides of said pair. It suffices merely to slot riders 8' having two lugs 9' (see FIG. 12) onto those tops 11' that are to support two shelves 13'.

In addition, when two shelves are installed in this way on opposite sides of the pair of uprights, they are at the same level.

It may be observed that the shelving of the invention satisfies hygiene standards which prohibit uprights 2' that have holes for the purpose of supporting shelves 13'.

The bottoms of the uprights are preferably provided with screws 17' enabling them to be adjusted vertically for standing on uneven ground.

Figure 11:
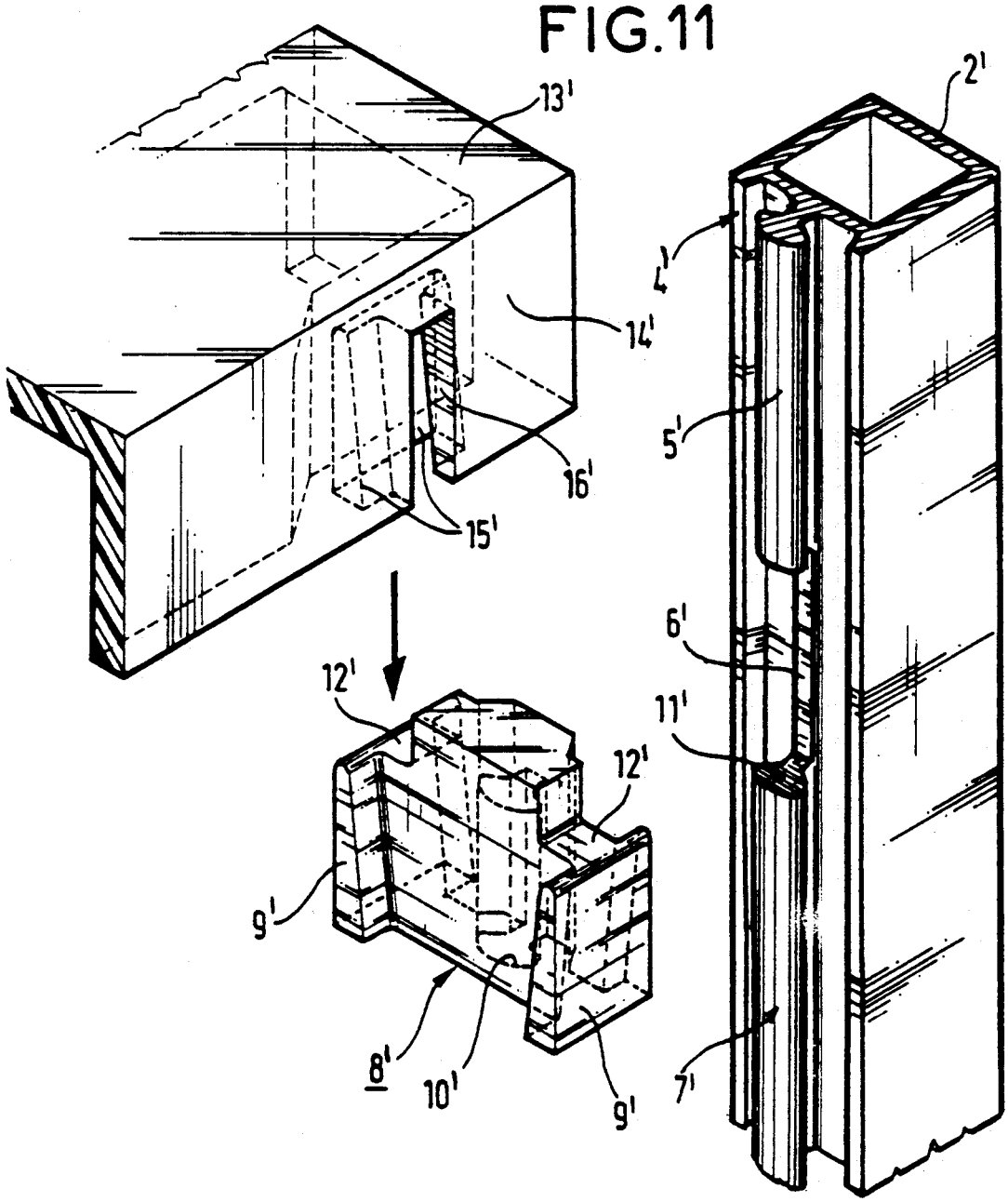
FIG. 11 is an exploded perspective view of a portion of the shelving of FIG. 12.
Figure 13:
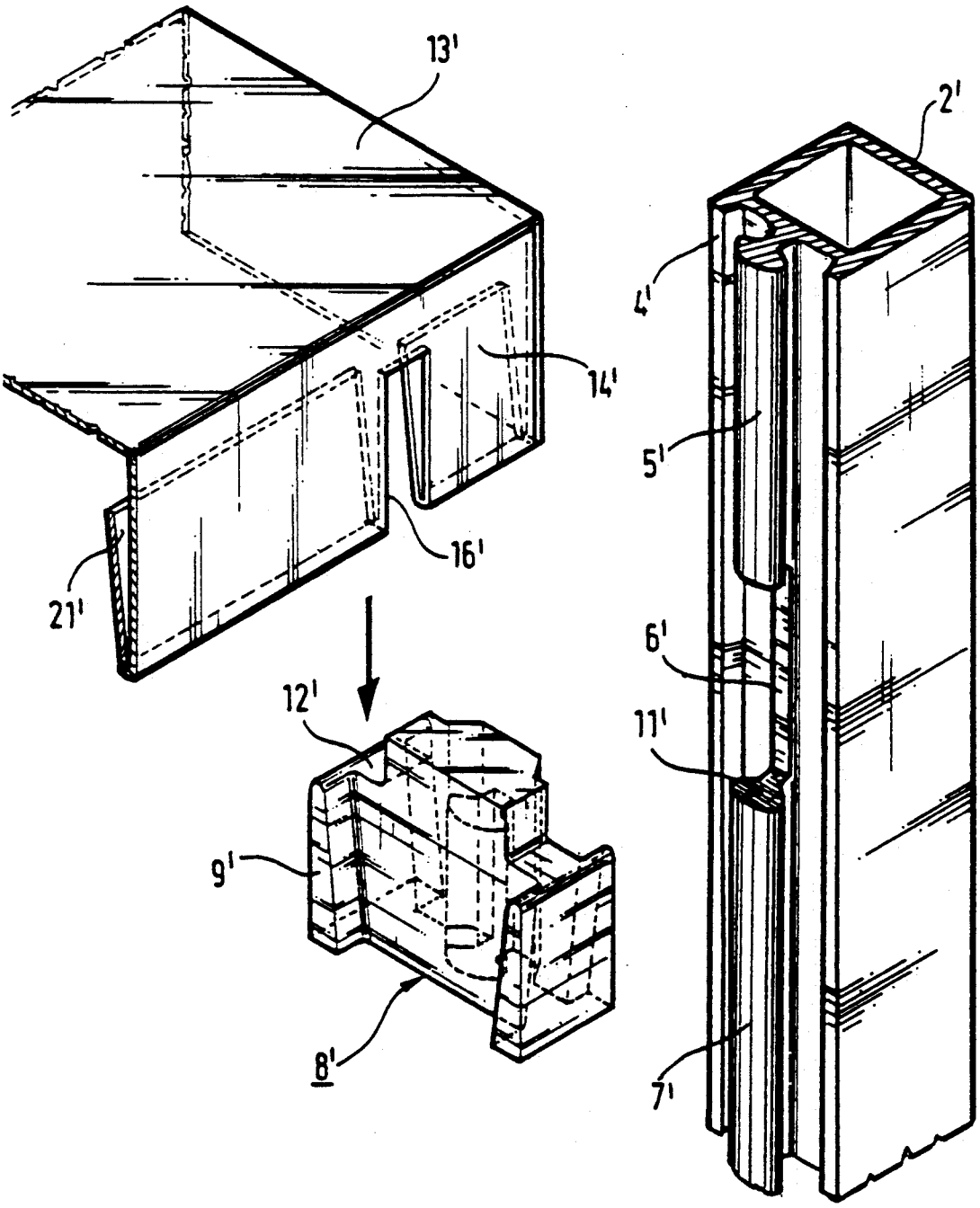
FIG. 13 shows a modification of the FIG. 11 variant.

FIG. 13 is a modification of FIG. 11 in which each end of the shelf 13' includes an inside flap 21' folded up from the bottom edge of the end. The notch 16' is formed in the end and also in the inside flap 21'. On assembly, the inside flap 21' presses against the lug 9' of the rider 8'.

We claim:

1. In a shelving system with removable shelves (13) having a recess (15) situated at each of four respective corners of the shelves, said system comprising pairs (1) of uprights (2), cross-bars (3) interconnected at opposite facing ends to respective uprights, the uprights (2) of a pair (1) having opposite faces and being provided on said opposite facing faces (4) with regularly spaced apart pegs (6), riders (8) placed on said pegs and removable therefrom only by being lifted, at least one lateral fastening lug (9) on each rider, said facing faces of said pair of uprights each defining a footprint, said lugs projecting laterally beyond the footprint of the facing faces of the pair (1) of uprights (2) and said riders engaging respective recesses (15) situated in each of the corners (14) of each shelf (13) and supporting said shelf (13) under the weight of the shelf.

2. A shelving system according to claim 1, wherein the pegs (6) are arch-shaped and have edges (5) provided with respective grooves (7) and said grooves receiving beading (11) of the riders (8).

3. A shelving system according to claim 1, wherein the lugs (9) taper in shape and engage corner recesses (15) of the shelves (13) of complementary tapered shape to lock said shelves (13) in place, under the effect of the weight of said shelves.

4. In a shelving system with removable shelves (13') having a recess (15) situated at each of four respective corners of said shelves, said system comprising pairs (1') of uprights (2'), the uprights (2') of a pair (1') being provided on opposite facing faces with dovetail tongues (5'), fixing cross-bars (3') having opposite ends (18')

provided with grooves (19') of complementary shape to said tongues (5') and releasably connected thereto, the improvement comprising said tongues (5') being split up to define regularly spaced apart gaps (6') forming lengths (7'), riders (9') having tops (11') provided with stopped grooves (10'), said stopped grooves being complementary in shape to the tongues (5'), said riders (8') being placed on said stopped grooves of said riders (8') being placed on said tongues (5'), said riders (8') each being provided with at least one lateral fastening lug (9') projecting laterally beyond a footprint defined by the facing faces of the pair (1') of uprights (2'), and said riders (8') engaging respective recesses (15') situated in each of the corners (14') of each shelf (13') and supporting said shelf (13') under the weight of the shelf.

5. A shelving system according to claim 4, wherein the lugs (9') taper in shape and engage said recesses (15') of the shelves (13') of complementary tapered shape to lock said shelves (13') in place, under the effect of the weight of said shelves.

* * * * *